US007112036B2

(12) United States Patent
Lubell et al.

(10) Patent No.: US 7,112,036 B2
(45) Date of Patent: Sep. 26, 2006

(54) ROTOR AND BEARING SYSTEM FOR A TURBOMACHINE

(75) Inventors: Daniel Lubell, Northridge, CA (US); Dennis Weissert, Simi Valley, CA (US)

(73) Assignee: Capstone Turbine Corporation, Chatsworth, CA (US)

( * ) Notice: Subject to any disclaimer, the term of this patent is extended or adjusted under 35 U.S.C. 154(b) by 0 days.

(21) Appl. No.: 10/862,136

(22) Filed: Jun. 4, 2004

(65) Prior Publication Data

US 2005/0089392 A1 Apr. 28, 2005

Related U.S. Application Data

(60) Provisional application No. 60/515,078, filed on Oct. 28, 2003, provisional application No. 60/559,378, filed on Apr. 2, 2004.

(51) Int. Cl.
*F01D 3/04* (2006.01)
*F01D 15/10* (2006.01)

(52) U.S. Cl. ..... 415/104; 415/107; 415/229; 417/365; 417/407; 417/411

(58) Field of Classification Search ..... 415/104, 415/107, 229, 1; 416/198 A, 175; 417/407, 417/410.1, 411, 365
See application file for complete search history.

(56) References Cited

U.S. PATENT DOCUMENTS

| | | | | |
|---|---|---|---|---|
| 4,808,070 | A * | 2/1989 | Fonda-Bonardi | 415/110 |
| 5,102,305 | A * | 4/1992 | Bescoby et al. | 417/407 |
| 5,427,455 | A | 6/1995 | Bosley | 384/106 |
| 5,497,615 | A * | 3/1996 | Noe et al. | 60/39.511 |
| 5,529,398 | A | 6/1996 | Bosley | 384/105 |
| 5,685,156 | A | 11/1997 | Willis et al. | 60/723 |
| 5,697,848 | A | 12/1997 | Bosley | 464/98 |
| 5,752,380 | A | 5/1998 | Bosley et al. | 60/39.281 |
| 5,791,868 | A * | 8/1998 | Bosley et al. | 415/104 |
| 5,827,040 | A * | 10/1998 | Bosley et al. | 415/106 |
| 5,915,841 | A | 6/1999 | Weissert | 384/104 |
| 5,918,985 | A | 7/1999 | Bosley et al. | 384/106 |
| 5,964,663 | A | 10/1999 | Stewart et al. | 464/98 |
| 6,037,687 | A | 3/2000 | Stewart et al. | 310/75 |
| 6,094,799 | A | 8/2000 | Stewart et al. | 29/525 |
| 6,158,892 | A | 12/2000 | Stewart et al. | 384/105 |
| 6,190,048 | B1 | 2/2001 | Weissert | 384/103 |
| RE38,373 | E | 12/2003 | Bosley | 384/106 |

(Continued)

FOREIGN PATENT DOCUMENTS

| | | | |
|---|---|---|---|
| US | 2002/0054718 | 5/2002 | 384/104 |

*Primary Examiner*—Ninh H. Nguyen
(74) *Attorney, Agent, or Firm*—Waddey & Patterson, P.C.; Lucian Wayne Beavers; Phillip E. Walker

(57) ABSTRACT

A rotor and bearing system for a turbomachine. The turbomachine includes a drive shaft, an impeller positioned on the drive shaft, and a turbine positioned on the drive shaft proximate to the impeller. The bearing system comprises one gas journal bearing supporting the drive shaft between the impeller and the turbine. The area between the impeller and the turbine is an area of increased heat along the drive shaft in comparison to other locations along the drive shaft. The section of the drive shaft positioned between impeller and the turbine is also a section of the drive shaft that experiences increased stressed and load in the turbomachine. The inventive bearing machine system positions only one radial bearing in this area of increased stress and load.

20 Claims, 5 Drawing Sheets

U.S. PATENT DOCUMENTS 6,702,463 B1 3/2004 Brockett et al. ..... 384/105
6,709,243 B1 3/2004 Tan et al. ..... 417/244
6,712,588 B1 * 3/2004 Ribaud ..... 417/407
6,751,941 B1 6/2004 Edelman et al. ..... 60/39.281

* cited by examiner

ROTOR AND BEARING SYSTEM FOR A TURBOMACHINE

CROSS-REFERENCES TO RELATED APPLICATIONS

This application is a claims benefit of co-pending U.S. patent application Ser. No. 60/515,078 filed Oct. 28, 2003, entitled "Rotor and Bearing System for a Turbomachine", and co-pending U.S. Provisional Patent Application Ser. No. 60/559,378 filed Apr. 2, 2004, entitled "Rotor and Bearing System for a Turbomachine", both of which are hereby incorporated by reference in their entirety.

STATEMENT REGARDING FEDERALLY SPONSORED RESEARCH OR DEVELOPMENT

This invention was made in conjunction with the United States Department of Energy's Advanced Microturbine System Project under contract number DE-FC 02-00CH11058. The United States government may have certain rights in this invention.

BACKGROUND OF THE INVENTION

The present invention relates to a unique and novel rotor and bearing system for an energy conversion machine, and more specifically to the placement of rotors and bearings within a turbomachine.

A turbomachine is an energy conversion machine. Typically a turbomachine can generate electric power and may include a compressor, turbine, gears, motors, and generators. In general, such a system includes one or more rotors supported on one or more bearings enabling free rotation of the shafts which carry the compressor wheel, turbine blades and permanent magnet rotor, or sleeve.

In high efficiency turbomachines such as those describes in U.S. Pat. Nos. 5,752,380 and 5,685,156, the efficiencies of the machines are substantially enhanced by the use of thrust and journal bearings of the compliant foil hydrodynamic fluid film type. Examples of these bearings are described in U.S. Pat. No. 5,427,455 and U.S. Application Publication No. 2002/0054718.

A turbomachine having three journal bearings and one thrust bearing is described in U.S. Pat. No. 5,697,848. The machine described in U.S. Pat. No. 5,697,848 is generally designed for kilowatt output (in the 30 KW range) and, for commercial efficiencies, is designed to be small, compact and easily transportable. Such machines have traditionally included journal bearings on either end of the permanent magnet shaft of the turbo generator. The powerhead of these turbomachines includes a compressor and turbine mounted on a shaft supported by a journal bearing and a thrust bearing positioned within the powerhead housing between the compressor and the turbine.

The conventional journal bearing includes stationary metallic foils positioned in close proximity to the rotating shaft. Additionally, the conventional thrust bearing includes a flange sandwiched between thrust bearings which are designed to restrict motion, counteract thrust loads, and dampen the transfer of vibratory thrust. These thrust bearings allow for thrust balancing and axial positioning of the permanent magnet shaft and the powerhead shaft. As such, the prior art positions at least one journal bearing and at least one thrust bearing between the compressor and turbine of the powerhead section.

The size and efficiency of these smaller prior art machines allow both the journal bearing and thrust bearing to be mounted between the compressor and the turbine. This is due to the controllable level of heat generated by the smaller overall design of these conventional systems. The present materials technology can design cost effective metal bearings that withstand the heat levels generated in the combustion chamber that power these smaller turbines. However, even in these smaller systems, the tremendous heat generated in the combustion chamber impacts the longevity of the journal and thrust bearings mounted adjacent the turbine. As such, those journal and thrust bearings can be the first components to fail in these machines because of their exposure to these heat levels.

Also, the configuration of the bearings and rotors in the prior art machines substantially block gas flow from the compressor to the bearings and on to the turbine. As such, without additional gas passages, or channels designed into the prior art machines, proper gas transfer from the compressor to the bearings and the turbine is not accomplished. Additionally, with the use of the gas passages that bypass the bearings, the natural convective cooling activity of the gas flow is not imparted to the bearings. These facts combined with the location of the thrust bearing and journal bearing near the combustion areas in the prior art turbomachines results in high operating temperatures for those prior art bearings. As such, these prior art bearings must be made of more expensive materials that tolerate high temperatures. Even then, these bearings in the prior art systems have a tendency to fail, break down, and malfunction.

It is also known, as is described in U.S. Pat. No. 5,697,848, to completely support the generator/motor rotor on gas bearings and to provide a flexible coupling between the permanent magnet shaft and the powerhead shaft. The flexible couplings transmit all torque from one rotor to the other, but radial excursions of one rotor generally do not affect the motion of the other rotor.

As discussed above, again as is illustrated in the U.S. Pat. No. 5,697,848, the powerhead shaft is carried by a journal bearing and a thrust bearing mounted between the compressor and the turbine. In larger machines, for example in a 200 kilowatt machine, the inventors have found that the extreme heat generated in the combustion chamber of the machine will exacerbate problems associated with the thrust bearing directly adjacent the hot section of the machine. The inventors have developed a unique and novel rotor and bearing system which alleviates these problems.

BRIEF SUMMARY OF THE INVENTION

Disclosed herein is a rotor and bearing system for a turbomachine. The turbomachine includes a drive shaft, an impeller positioned on the drive shaft, and a turbine positioned on the drive shaft proximate to the impeller. The bearing system comprises one gas journal bearing supporting the drive shaft between the impeller and the turbine. The area between the impeller and the turbine is an area of increased heat along the drive shaft in comparison to other locations along the drive shaft. The section of the drive shaft positioned between impeller and the turbine is also a section of the drive shaft that experiences increased stressed on load in the turbomachine. The inventive bearing machine system positions only one radial bearing in this area of increased stress and load.

The turbomachine can be described as having a shaft, a powerhead assembly, and a magnetic assembly. The shaft can be described as having a magnetic shaft in the magnetic assembly and a drive shaft in the powerhead assembly and compound flexible shaft connecting the powerhead assembly to the magnetic assembly.

Additionally, the turbomachine has a fore end and an aft end, where in the magnetic assembly is positioned towards the fore end of the turbomachine and the powerhead assembly is positioned toward the aft end of the turbomachine.

The magnetic assembly includes a rotating magnet and a stationary magnet, or generation coil or field, used to generate electricity. The powerhead assembly includes a turbine powered by a combusted fluid, wherein the turbine is used to power the shaft of the turbo generator. The powerhead assembly also includes an impeller, or compressor, attached to the drive shaft portion of the main shaft. The compressor is preferably positioned toward the fore end of the turbine and is used, in part, to maintain the pressure of the gas used within the turbine for balancing and cooling of the elements within the turbomachine.

The inventive bearing system includes a single bearing positioned between the turbine and the impeller. Due to the operation and the logistics of the individual components of the turbo generator, the area between the turbine and the impeller is the area of the shaft that experiences the higher temperature, larger load, increased stressed, and larger radial forces as compare to the other portions of the shaft. As such, it is contemporary wisdom to position multiple bearings within this area of increased temperature, pressure, and stress. The current invention, however, provides a unique break from this conventional wisdom. Namely, the current invention moves all but a single bearing away from this area of increased temperature, stress, and pressure and, in doing so, reduces the overall temperature and wear on the bearings used in the energy conversion machine.

The increased productivity, reduced temperature, and increased lifespan of the bearings in the inventive bearing system results from several factors. First of all, the positioning of a single radial gas bearing between the turbine and the impeller within the powerhead assembly allows gas to substantially flow between these two elements within an area of increased heat, which aids in the cooling of the remaining elements located between the turbine and the impeller. The flow of gas in the current invention is now across the single radial bearing and, as such, cools this bearing through convection.

An another benefit of the inventive bearing system is that separation of the thrust bearing and at least one radial bearing away from the area of increased heat, or hot section, reduces the overall temperature of all three bearings. A bearing will create significant heat on its own, simply from its operation. Having multiple bearings (axial or radial) operating within a given area increases the heat load, and reduces the heat escape options, or cooling options, in that given area, especially if that given area has other heat source that require heat dissipation. As such, the novel layout also simplifies cooling for each bearing through the reduction of the need for additional air passages as well as reducing the very need for heat dissipation by reducing the proximity of the various bearings in relation to one another and by removing some of the bearings from an area of increased heat. This is especially true for the thrust bearing, which has a greater heat generation a larger reducing on cooling gas flow in the relation to radial bearings.

Additionally, the movement of the other bearings away from this area of increase temperature and stress reduces the temperature and stress on those bearings and reduces the temperature of the area of increased heat. As such, the lifespan of the bearings is considerably increased.

Additionally, the increased flow of gas from the compressor to the turbine facilitates a more efficient use of the pressure drop between the compressor and the ambient air. The increased pressure at the thrust rotor and thrust bearing used to maintain the axial positioning of the shaft and its attached components can also be used to facilitate the convective cooling of the bearings. Conversely, prior art turbomachines could not efficiently use this pressure drop due to the fact that the use of multiple bearings between the turbine and the impeller substantially impeded and complicated the gas flow. In most circumstances, the use of multiple bearings in this area made the convective cooling effect of the gas across these bearings almost negligible.

Preferably, the present invention includes powerhead radial rotors configured with a radial gas bearing and positioned at the each end of the flexibly coupled compound shaft. Additionally, a thrust rotor having a thrust disc or flange extending radially outward from the rotor housing is located aft of one of the powerhead radial rotors and bearings. This radially positioned gas bearing supports this thrust rotor and thrust disc. The thrust bearing is sometimes described as a double acting bearing or a pair of bearings due to the number of thrust discs used within the bearing or due to the bidirectional support the thrust bearing provides along the axis.

Adding an additional radial gas bearing on the fore side of the thrust disc provides additional support for a larger turbo generating systems and enables a thrust bearing to be positioned at a maximum distance from the turbine stages of the turbomachine. This provides a longer bearing span and permits cooler operation of that bearing. Further, the position of the thrust disc and thrust bearing that axially supports the shaft and its attached members also improves the system. Positioning the thrust disc between the electricity generator, or motor, and the compressor stages allows effective control of the axial positioning of the compressor within the static structure.

The compressor stage, or stages, is aft of the thrust disc, and as close as may be permitted within design requirements to the thrust disc. Another gas bearing is position aft of the compressor stage and immediately forward of the turbine stage. The powerhead shaft passes through the compressor wheel and this radial gas bearing. The shaft and bearing carry the turbine blades adjacent to the combustion chamber of the system. While this radial gas bearing is proximate to the turbine and is subject to the extreme heats that are transmitted from the combustion chamber, the temperature of this radial gas bearing is less than the temperature of radial bearing similarly situated in conventional turbomachines. This temperature difference is due to the increased convective cooling of this bearing by the gas from the compressor and the removal of the other bearings as a heat generating source. Additionally, the positioning of any additional radial gas bearings and the thrust bearing away for the combustion areas allow for greater heat dissipation, cooler operation, and less exposure of these other gas bearings to the heat adjacent the turbine. This is due in part to the fact that the compressor is between these additional gas bearings and the combustion chamber.

Additionally, the turbine stage is overhung on the shaft of the bearing such that gas flow through the stage is unimpeded with further rotor components or bearings, thus increasing the efficiency of the system.

It is therefore a general object of the present invention to provide an improved energy converting machine.

It is another object of the present invention to improve the rotor and bearing system of a turbomachine.

Another object of the present invention to provide a novel bearing arrangement within a turbomachine.

Yet another object of the present invention is to position a single bearing between the compressor and turbine of a turbomachine.

Yet, still another object of the present invention is to position a bearing that axially supports a power shaft away from an area on the power shaft that has an increased temperature, increased stress, and increased load.

In yet still another object of the present invention is to provide increased convective cooling for the radial bearing positioned between a compressor and a turbine in a turbomachine.

Numerous other objects, features and advantages of the present invention will be readily apparent to those skilled in the art, upon a reading of the following disclosure, when taken in conjunction with the accompanying drawings.

BRIEF DESCRIPTION OF THE SEVERAL VIEWS OF THE DRAWINGS

FIG. 3 shows in greater detail a powerhead assembly of a turbomachine implementing an embodiment of the rotor and bearing system.

DETAILED DESCRIPTION OF THE INVENTION

Figure 1:
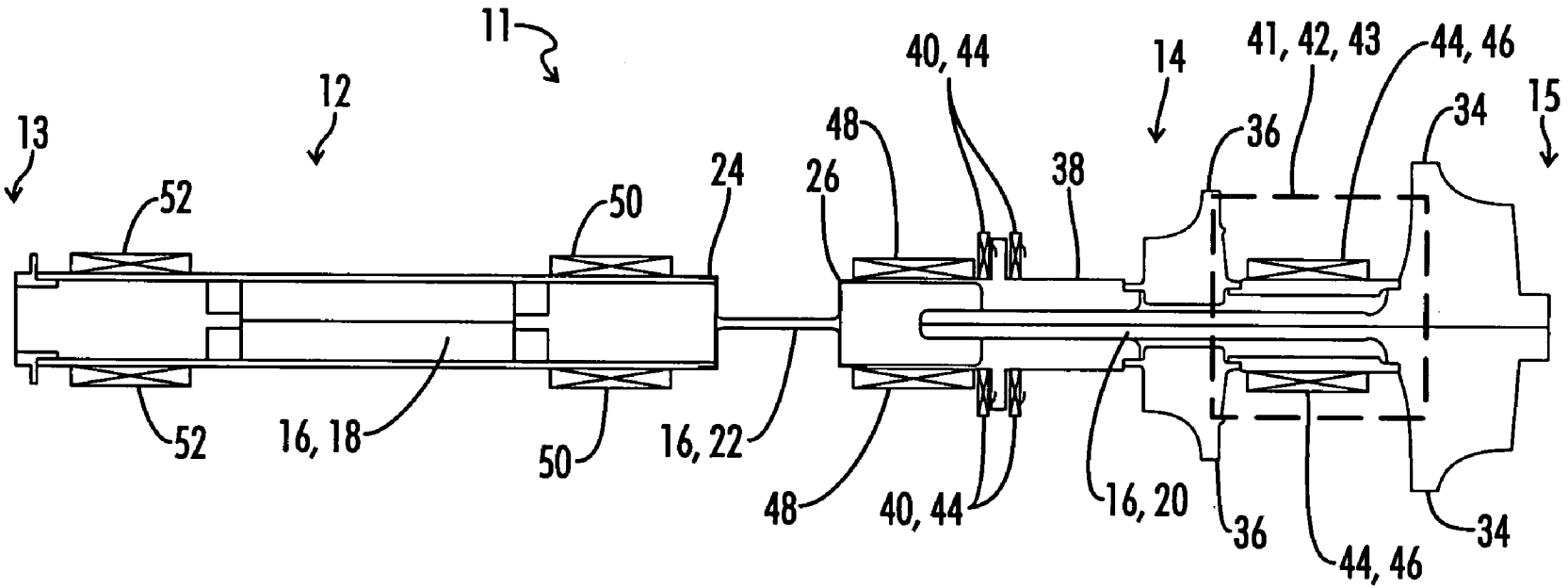
FIG. 1 shows a schematic cross-sectional view of one embodiment of the rotor and bearing system of the present invention.
Figure 2:
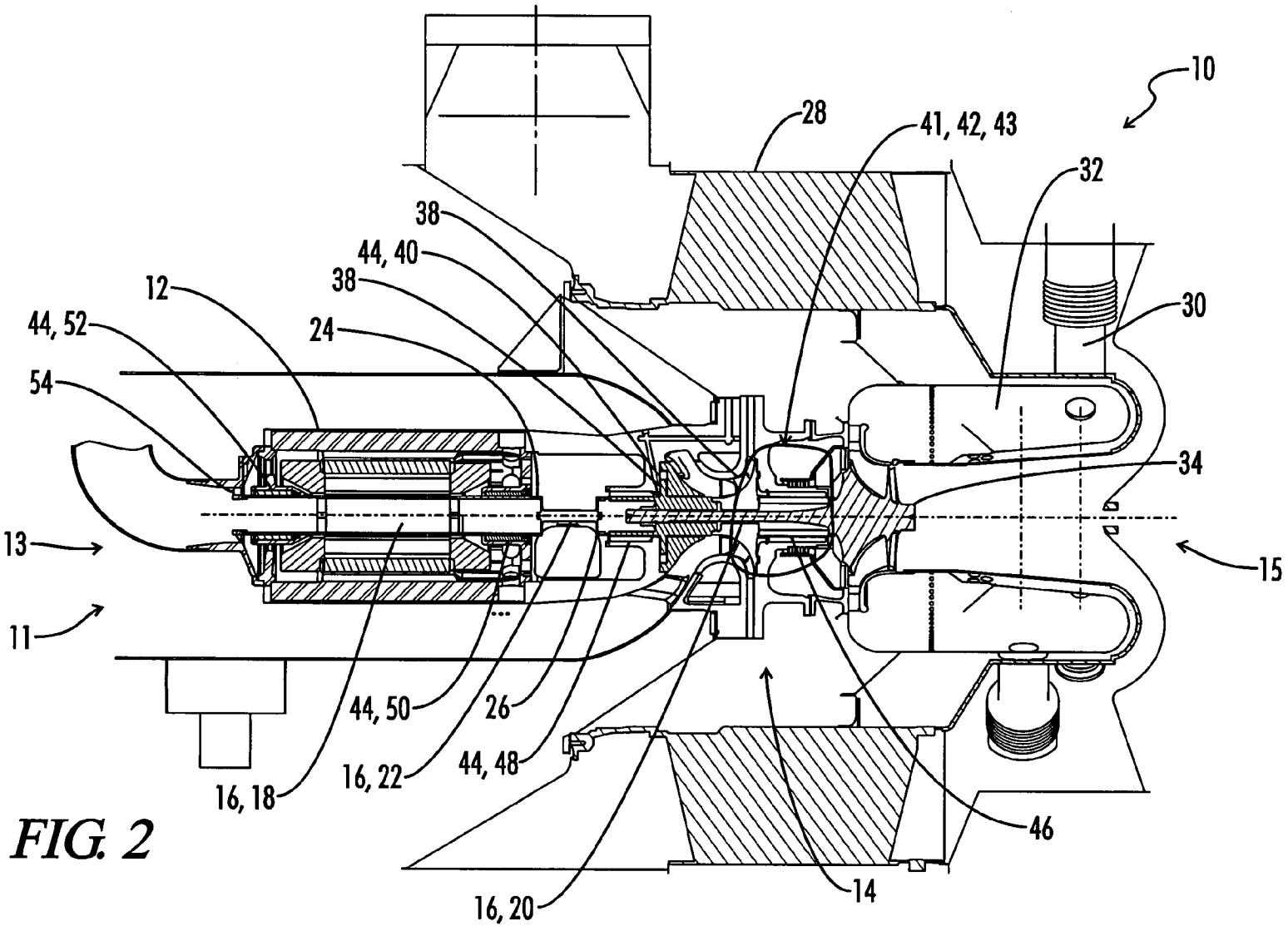
FIG. 2 is a partial sectional view of one embodiment of a turbomachine comprising the rotor and bearing system.
Figure 3:
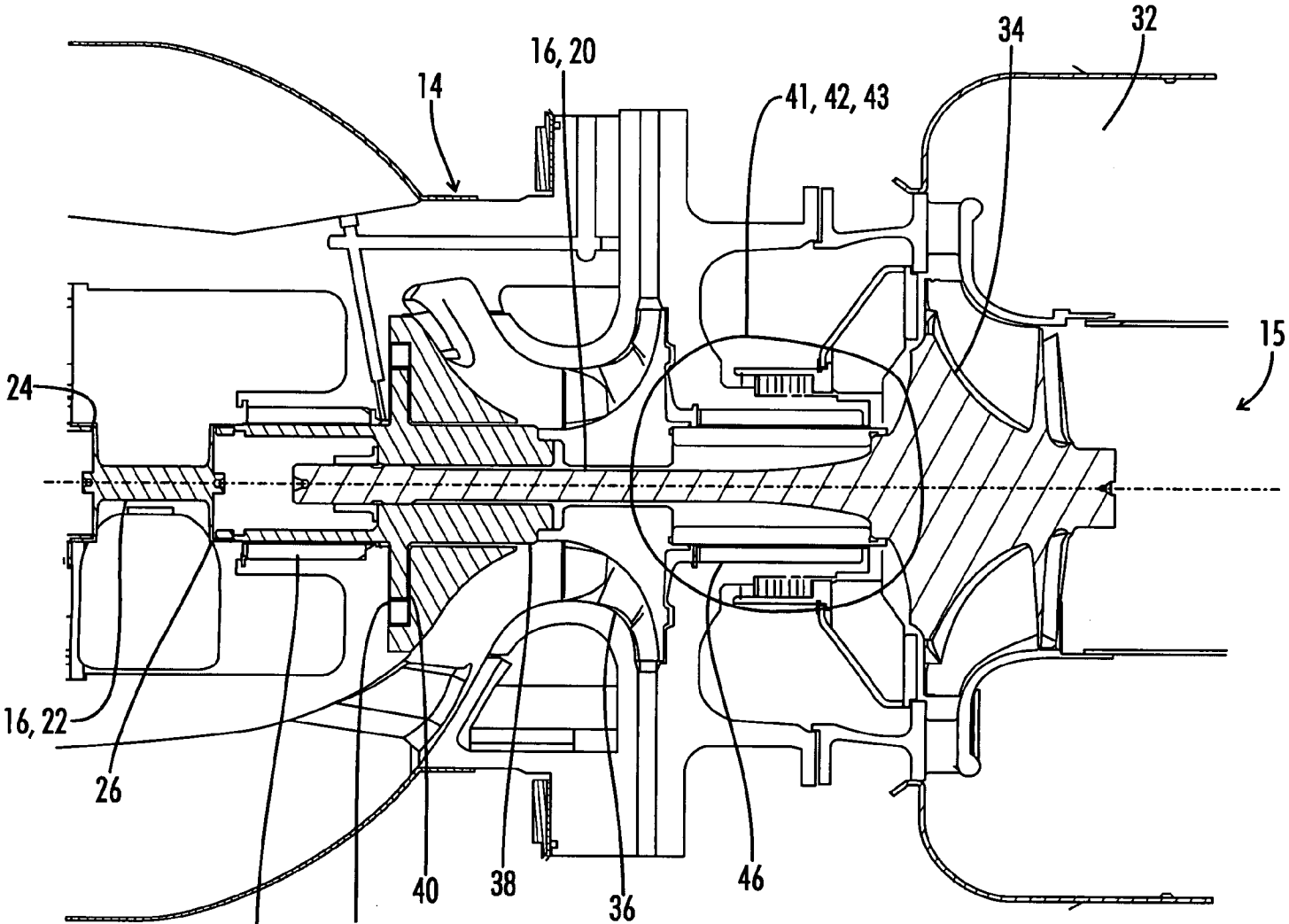
FIG. 3 is a cross-sectional view similar to FIG. 2.

Referring now generally to FIGS. 1 through 5. An energy conversion machine is shown and generally designated by the numeral 10. The energy conversion machine 10 can also be described as a turbomachine 10. The turbomachine 10 includes a magnetic assembly 12 and a powerhead assembly 14. The magnetic assembly 12 can also be described as the generator 12 or motor 12. Preferably the magnetic assembly 12 uses the kinetic energy of the rotating shaft 16, and more specifically the magnetic shaft 18, to produce electricity.

The turbomachine 10 includes a heat exchanger 28 which can also be described as a recouperator 28, or recuperator 28, used to increase energy conversion efficiency. The fuel injector 30 is used to supply fuel to the combustion chamber 32 which then uses the ignited fuel to supply the energy force used to propel the powerhead assembly 14.

Also included is a shaft 16 spanning the magnetic assembly 12 and the powerhead assembly 14. The shaft 16 includes a magnetic shaft 18 located in the magnetic assembly 12 and drive shaft 20 located in the powerhead assembly 14. The magnetic shaft 18 and drive shaft 20 are connected by a compound flexible shaft 22 containing couplings 24 and 26 that engage the magnetic shaft 18 and drive shaft 20, respectively, to allow the transmission of the torque from the drive shaft 22 to the magnetic shaft 18. The compound flexible shaft 22 does not transmit radial movement along the shaft 16.

The power assembly 14 includes a turbine 34 positioned on the drive shaft 20 to accept the energy input from the combustion chamber 34 to continue the conversion process between forms of energy. Also included in the powerhead assembly 14 is a compressor 36, which can also be described as an impeller 36. The compressor 36 is positioned on the drive shaft 20 proximate to the turbine 34. The compressor 36 is used to facilitate gas pressure and gas direction within the powerhead assembly 14.

The powerhead assembly 14 also includes a thrust rotor 38 used in conjunction with at least one thrust bearing 40 to maintain the axial positioning of the shaft 16 and elements attached thereto. The thrust bearing 40 can be described as an axial bearing 40 and the thrust rotor 38 can be described as an axial rotor 38. The axial rotor 38 and axial bearings 40 are used to control the axial displacement of the shaft 16 during the operation of the turbomachine 10. The thrust bearings 40 are preferably of the compliant foil hydrodynamic fluid film type as described, for example, in U.S. Pat. No. 5,529,398. Additionally, the powerhead assembly 14 includes a location of increased heat that extends to cover an area of the drive shaft 20 of the powerhead 14. A majority of this heat is generated by the combustion of fuel in the combustion chamber 32.

The novel invention is a rotor and bearing system 44, which can also be described as a bearing system 44, used to support the shaft 16 during the operation of the turbomachine 10. The bearing system 44 has only one gas bearing 46 positioned in the location of increased heat 42. In a preferred embodiment the one gas bearing 46 is a fluidly interacting radial gas bearing 46 used to support the shaft 16 and to control the radial movement of the shaft 16 and its attached elements. The radial bearing 46 can also be described as a journal bearing 46 and is preferably a compliant foil hydrodynamic fluid film bearing.

A key element of the bearing system 44 is the fact that there is only one gas bearing 46 positioned in the location of increased heat 42. This location of increased heat can also be the location of increased load 43 on the shaft 16 and in the powerhead assembly 14. The location of increased heat can also be described as the location of increased stress 41 on the shaft 16 or the location of increased radial loads 43 on the shaft 16.

The novel bearing system 44 further includes a thrust bearing 40 positioned remote from the location of increased heat 42. Also, a second gas bearing 48 is positioned remote from the location of increase heat 42. This second gas bearing 48 is preferably a journal bearing. The location of increased heat 42 is located between the turbine 34 and the compressor 36. This location between the turbine 34 and compressor 36 includes the portion of the drive shaft 20 that is closest to the combustion chamber 32 of the turbomachine 10.

In this embodiment of the bearing system 44, the thrust rotor 38 and thrust bearing 40 are positioned substantially adjacent to the impeller 36 but opposite the location of increased heat 42. As seen in the schematic shown in FIG. 1, the drive system 11 can be described as having a fore end 13 and an aft end 15. As such, the thrust rotor 38 and thrust bearing 40 are positioned on side of the impeller 36 facing the fore end 13, while the only one gas bearing 46 is positioned between the impeller 36 and the turbine 34 in the location of increased heat 42. The axial bearing 40 and axial rotor 38 are fluidly engaged using the gas supply to the drive system 11 of the turbomachine 10. The positioning of the axial bearing 40 and the axial rotor 38 can be described as having the impeller 36 positioned between the axial rotor 38 and the turbine 34.

Preferably a second gas bearing 48 is positioned on the side of the thrust rotor 38 facing towards the fore end 13 of the turbomachine 10. The positioning of this second gas journal bearing 48 can also be described as having the impeller 36 positioned between the second gas bearing 48 and the turbine 34.

The positioning of the second gas journal bearing 48, its associated rotor (not shown), the thrust rotor 38, and thrust bearing 40 can vary along the drive shaft 20. Preferably these bearings and rotors are positioned as far away from the location of increased heat 42 as possible while still maintaining adequate support for the drive shaft 20 while the drive shaft 20 rotates. The interaction between the bearings and the rotors is based upon the fluid dynamic property of the gas positioned between these bearings and rotors given the specific geometric configurations of the bearings, rotors, and shaft 16.

The positioning of the single gas bearing 46 between the compressor 36 and turbine 34 increases the gas flow from the impeller 36 to increased temperature section, or hot section, in the direction of the turbine 34. This increased gas flow in turn decreases the temperature of the single gas bearing 46. The increased gas flow is a result of the reduction in gas flow impediments positioned between the impeller 36 and the turbine 34, as compared to prior art machine. As previously mentioned, in prior art machines the thrust rotor, thrust bearing, and at least two journal bearings were located between the impeller and the turbine. This prior art placement followed the conventional wisdom of needing the most shaft support in the area of increased load, stress, and heat. However, the current bearing system 44 relocates the thrust rotor 38, thrust bearing 40, and second journal bearing 48 out of the areas of increased stressed 41, heat 42, load 43. As a result, the gas within the powerhead assembly 14 has an easier path due to the less resistance between the impeller 36 and turbine 34.

Figure 4:
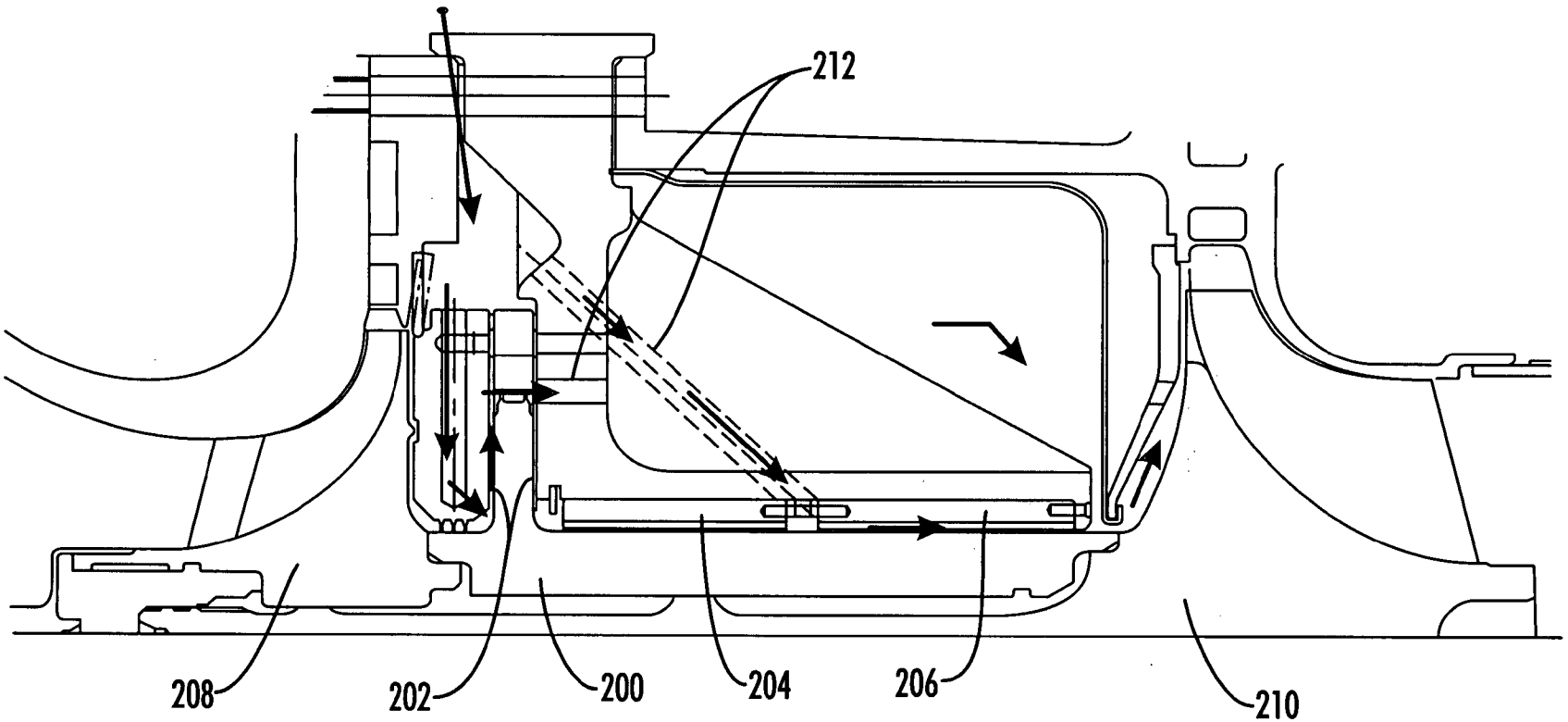
FIG. 4 (PRIOR ART)
FIG. 4 is a partial cross-sectional view of a prior art turbomachine.

As shown in FIG. 4, the prior art included the thrust rotor 200, thrust bearing 202, and two journal bearings 204 and 206 between the impeller 208 and turbine 210. As a result, air flow openings 212, or access channels 212, were required to facilitate a flow of gas from the impeller 208 to turbine 210. The prior art air flow is indicated by the arrows drawn in FIG. 4.

Figure 5:
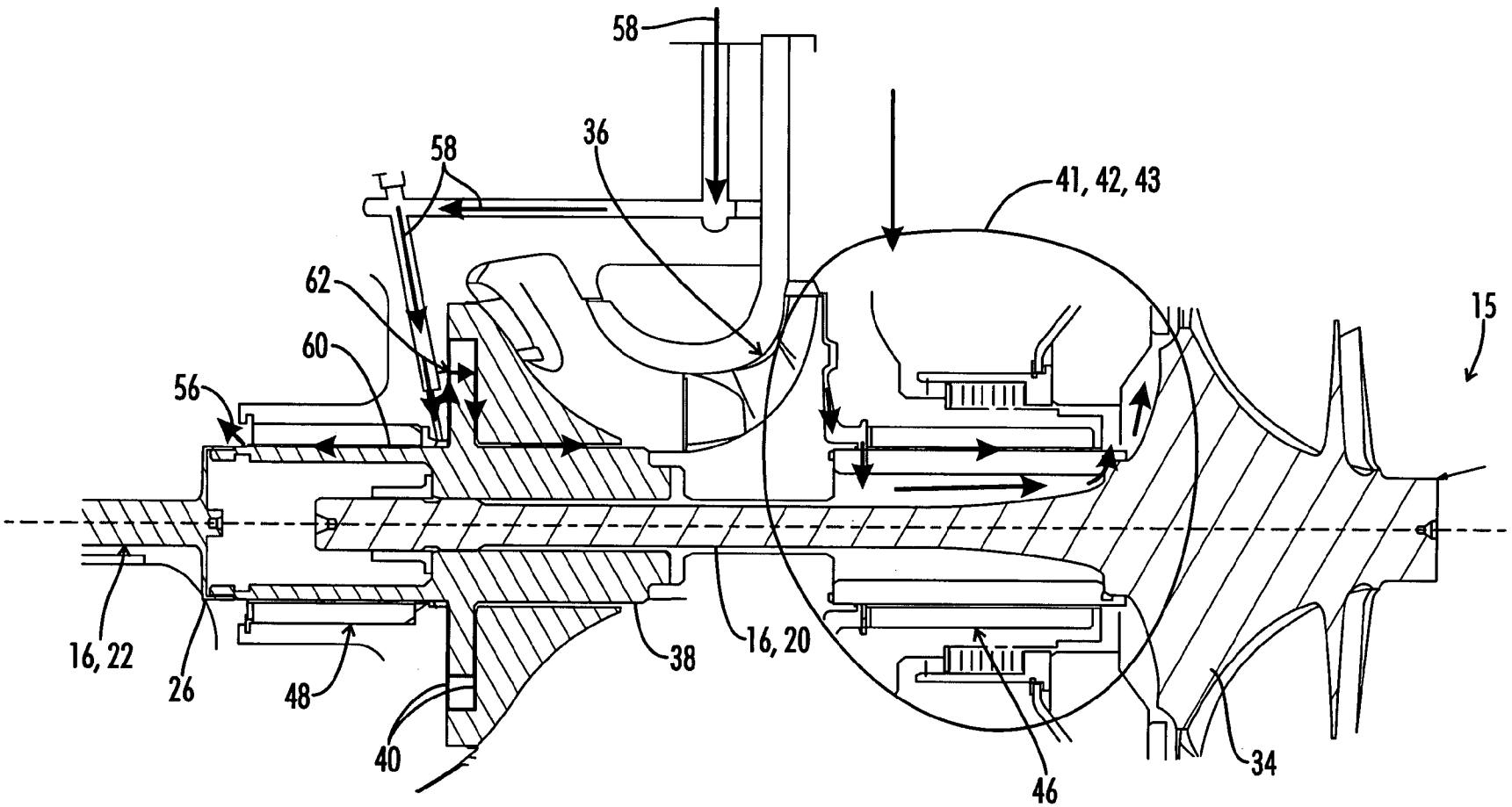
FIG. 5 is a partial cut-away view showing a more detailed view of the gas flow within the powerhead assembly of a turbomachine implementing the rotary and bearing system of the current invention.

Conversely, looking at FIG. 5. the air flow between the impeller 36 and the turbine 34 is greatly increased due to the placement of a single gas bearing 46 between these two elements. As such, due to the convective effect of the gas flow, the single gas bearing 46 operates at a cooler temperature and therefore experiences an increased working life. Additionally, the removal of the thrust bearing 40 and second gas bearing 48 away from the location of increased heat 42 also increases the working life of those bearings and reduces the heat generation in location of increased heat 42.

Due to the introduction of gas near the impeller 36 and the functioning of the impeller 36 itself, the gas pressure surrounding the impeller 36 is greater than the gas pressure surrounding the turbine 34. The positioning of a single gas journal bearing 36 between the impeller 36 and turbine 34 induces gas flow from the first, or higher, gas pressure near the impeller 36 to the second, or lower, gas pressure near the turbine 34, for a secondary or cooling flow of the gas.

In a most preferred embodiment, the bearing system further includes a third gas journal bearing 50 and fourth gas journal bearing 52. The third and fourth gas journal bearings 50 and 52 are positioned in the magnetic assembly 12 to radially support the magnetic shaft 18. These third and fourth gas journal bearings 50 and 52 can also be described as first and second fore end gas journal bearings 50 and 52 due to their preferred positioning towards the fore end 13 of the drive system 11. The magnetic assembly 12 can also include a cooling fan 54 used to maintain the temperature of the magnetic assembly 12.

As seen in FIG. 5 in a preferred embodiment of the current invention, supply gas 58 is supplied to the fore end of the thrust rotor 38 and is then diverted in at least two directions 60 and 62. The first direction 60 is towards the fore end 13 of the turbomachine 10. The gas diverted in this direction is used to help maintain the temperature of the second gas journal bearing 48. Gas moving in the second direction 62 is used to maintain the temperature and loading of the thrust disc that comprise part of the thrust bearing 40. The impeller 36 by its nature increases the pressure of the gas near the impeller 36 and pushes that gas toward the turbine 34. As seen in FIG. 5, the use of a single gas journal bearing 46 between the impeller 36 and the turbine 34 allows a freer flow of gas between the impeller 36 and turbine 34 when compared to the prior art turbomachines. An additional benefit of the relocation of thrust rotor 38, thrust bearing 40, and second gas journal bearing 48 away from the combustion chamber 32 allows at least a portion of the cooling air supplied to be released into the ambient air pressure of the machine, as indicated by numeral 56.

Another advantage over the current bearing system 44 is the fact that cheaper materials can be used to make the bearings of the bearing system 44 due to the reduction in operating temperature. For example, prior art bearings placed within the increased temperature zone were required to be composed of steel or a type of a material more resistant to thermal fatigue, such as nickel alloys. However, using the current rotor and bearing system, the bearing components can be made of materials that do not require the same thermal tolerance. For example, aluminum is a type of material that can be used to create bearing housings to support these bearings and still maintain the high level of efficiency and operability within the turbomachine 10.

Thus, although there have been described particular embodiments of the present invention of a new and useful Rotor and Bearing System for a Turbomachine, it is not intended that such references be construed as limitations upon the scope of this invention except as set forth in the following claims.

What is claimed is:

1. A bearing system for a turbomachine, the turbomachine including a powerhead assembly having a shaft and a location of increased heat, the bearing system comprising only one gas bearing positioned in the location of increased heat, the only one gas bearing positioned to support the shaft and further including a gas thrust bearing positioned remote from the location of increased heat.

2. The bearing system of claim 1, wherein the only one gas bearing is a radial bearing.

3. The bearing system of claim 2, wherein the turbomachine further includes a compressor and a turbine and the location of increased heat is located between the compressor and the turbine.

4. The bearing system of claim 1, wherein the location of increased heat is also a location of increased load.

5. The bearing system of claim 1, further including a second gas bearing positioned remote from the location of increased heat.

6. The bearing system of claim 1, wherein the turbomachine further includes an impeller and a turbine and the location of increased heat is located between the impeller and the turbine.

7. The bearing system of claim 6, wherein the position of the only one gas bearing increases gas flow from the impeller to the turbine.

8. The bearing system of claim 7, wherein the increased gas flow from the impeller to the turbine decreases the temperature of the only one gas bearing.

9. A bearing system for a turbomachine, the turbomachine including a powerhead assembly having a shaft and a location of increased heat, the bearing system comprising only one gas bearing positioned in the location of increased heat, the only one gas bearing positioned to support the shaft, wherein the turbomachine further includes an impeller and a turbine and the location of increased heat is located between the impeller and the turbine, and further including a thrust bearing positioned near the impeller and opposite the location of increased heat.

10. A bearing system for a turbomachine, the turbomachine including a drive shaft, an impeller positioned on the drive shaft, and a turbine positioned on the drive shaft proximate to the impeller, the bearing system comprising only one gas bearing supporting the drive shaft between the impeller and the turbine, and further including at least one gas axial bearing supporting the drive shaft wherein the impeller is positioned between the turbine and the at least one gas axial bearing.

11. The bearing system of claim 10, further including an axial rotor attached to the drive shaft and fluidly engaging the at least one gas axial bearing, wherein the at least one gas axial bearing and the axial rotor axially position the drive shaft, the impeller, and the turbine.

12. The bearing system of claim 10, further including a second gas journal bearing supporting the drive shaft wherein the impeller is positioned between the turbine and the second gas journal bearing.

13. The bearing system of claim 10, wherein the impeller has a first gas pressure and the turbine has a second gas pressure; and the one gas journal bearing is positioned to allow increased gas flow from the first gas pressure to the second gas pressure.

14. The bearing system of claim 13, wherein the increased gas flow from the first gas pressure to the second gas pressure decreases the temperature of the one gas journal bearing.

15. A bearing system for a turbomachine, the turbomachine including a drive shaft, an impeller positioned on the drive shaft, and a turbine positioned on the drive shaft proximate to the impeller, the bearing system comprising only one gas bearing supporting the drive shaft between the impeller and the turbine, wherein the turbomachine further includes a magnetic assembly positioned distal to the turbine and having a magnetic shaft and a first fore end gas journal bearing supporting the magnetic shaft.

16. The bearing system of claim 15, further including a second fore end gas journal bearing supporting the magnetic shaft.

17. A bearing system for an energy conversion machine, the energy conversion machine including a magnetic assembly and a powerhead assembly operatively attached to the magnetic assembly, the magnetic assembly including a magnetic shaft, the powerhead assembly including a drive shaft, a compressor positioned on the drive shaft and having fore and aft ends, and a turbine positioned on the drive shaft near the aft end of the compressor, the bearing system comprising:

a single gas journal bearing positioned between the compressor and the turbine to radially support the drive shaft; and a thrust bearing positioned near the fore end of the compressor to axially support the drive shaft.

18. The bearing system of claim 17, further including a second gas journal bearing positioned near the fore end of the compressor to radially support the drive shaft.

19. The bearing system of claim 17, further including third and fourth gas journal bearings positioned in the magnetic assembly to radially support the magnetic shaft.

20. A rotor and bearing system for an energy conversion machine, the energy conversion machine including a magnetic assembly and a powerhead assembly operatively attached to the magnetic assembly, the magnetic assembly including a magnetic shaft, the powerhead assembly including a drive shaft, a compressor positioned on the drive shaft and having fore and aft ends, and a turbine positioned on the drive shaft near the aft end of the compressor, the rotor and bearing system comprising:

a single gas journal bearing positioned between the compressor and the turbine to radially support the drive shaft;

a thrust bearing positioned near the fore end of the compressor; and a thrust rotor attached to the drive shaft and fluidly engaging the thrust bearing, wherein the thrust bearing and the thrust rotor axially position the drive shaft, the compressor, and the turbine.

* * * * *